United States Patent [19]

Larsen

[11] 3,936,235

[45] Feb. 3, 1976

[54] FUEL OIL SUPPLY MEANS

[75] Inventor: Peder Larsen, Augustenborg, Denmark

[73] Assignee: Danfoss A/S, Nordborg, Denmark

[22] Filed: Aug. 7, 1974

[21] Appl. No.: 495,386

[30] Foreign Application Priority Data

Aug. 21, 1973 Germany ..... 2342112

[52] U.S. Cl. ..... 417/279; 417/458; 137/505.42

[51] Int. Cl.² ..... F04B 49/00

[58] Field of Search ..... 417/279, 458, 417; 137/505.42, 568

[56] References Cited

UNITED STATES PATENTS

| | | | |
|---|---|---|---|
| 2,634,805 | 4/1953 | Bills et al. | 417/417 |
| 3,017,057 | 1/1962 | Reed | 137/568 |
| 3,357,687 | 12/1967 | Vanderpoel | 137/505.42 |

*Primary Examiner*—William L. Freeh
*Assistant Examiner*—G. P. LaPointe

[57] ABSTRACT

The invention relates to a fuel oil supply assembly of the type having a magnetic pump and an armature for driving a pump element or piston which is a part of a resilient oscillatory system. A flow restricting pressure regulating vlave in the delivery line is itself regulated in a manner such that the stroke of the oscillatory system is automatically adjusted so that only the exact quantity of oil required by the nozzle is delivered. The intermittent delivery movement inherent in the oscillatory system is thus made smoother by a damping of the oscillations which results from the piston being caused to travel over only a fraction of its maximum stroke.

3 Claims, 1 Drawing Figure

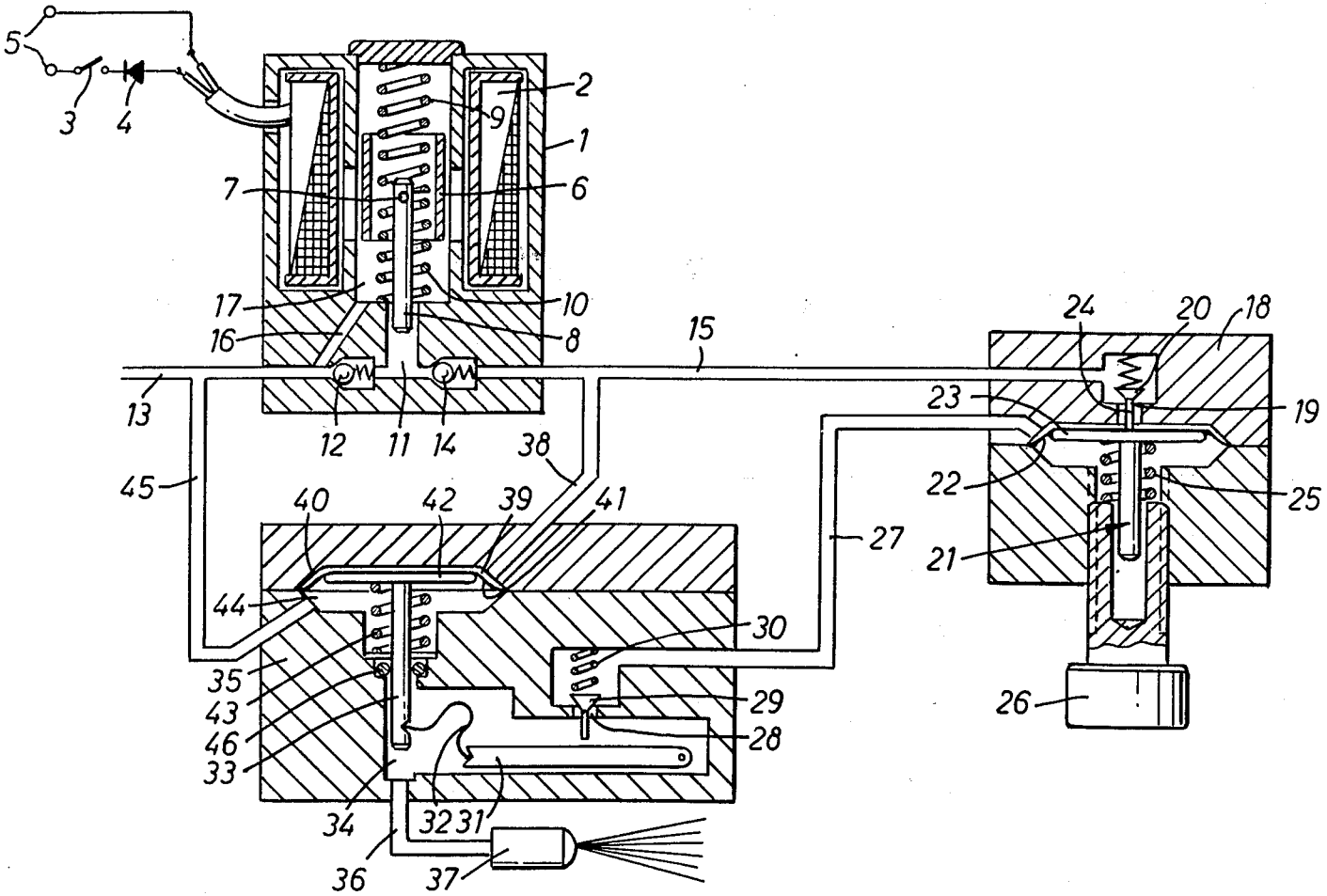
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46

FUEL OIL SUPPLY MEANS

The invention concerns a fuel oil supply means with a magnetic pump, the armature of which, for driving the pump element, e.g. a piston, is part of a resilient oscillatory system which is energized by periodic pulses of energizing current, e.g. alternating current, supplied through a half-wave rectifier, the supply means also having a pressure regulator for fixing the delivery pressure.

Fuel oil supply means generally have continuously operating positive-displacement pumps, e.g. geared pumps. For the purpose of regulating pressure, use is made of a valve which is fitted in a return line branching off immediately downstream of the pump and which opens as pressure rises and returns the excess oil either to the suction side of the pump or to the tank. This pressure-regulating device may be set to a particular pressure to suit the nozzle used, so that one type of pump may be employed for different overall arrangements. A cut-off valve is also fitted upstream of the nozzle and this valve closes as soon as the delivery pressure drops below a predetermined level.

Also known are magnetic pumps, the armature of which is part of a resilient oscillatory system which is energized by alternating current supplied through a half-wave rectifier. Among the many possible uses of this pump, mention is made of the supply of fuel oil. For pressure-regulation purposes, the magnetic pump has a valve which opens with rising pressure and is provided in a duct which directly connects the pressure side to the suction side. The intermittent delivery movement leads to corresponding pressure pulses in the supply system which are disadvantageous as regards formation of a flame and for noise reasons. The piston which is reciprocated fifty times per second over its entire stroke suffers corresponding wear which shortens its service life.

The object of the present invention is to provide a fuel oil supply means of the initially described kind in which the disadvantageous consequences of intermittent operation are entirely or partially removed.

According to the invention, this object is achieved in that the pressure regulator is constituted by a flow-restricting member in the delivery line.

With this arrangement, the stroke of the oscillatory system is automatically adjusted so that only that quantity of oil required by the nozzle is delivered. If the stroke increases, the pressure upstream of the flow-restricting zone rises and this leads to a corresponding damping of the oscillations. Since the piston generally moves over only a fraction of its maximum stroke, less wear is caused and a longer service life obtained. The pressure pulses in the supply system and their consequences are smaller. Excess oil is not returned to the suction side and this has the effect of reducing the power required.

With particular advantage, the flow-restricting member is controlled by a pressure-regulating control element which is provided downstream thereof, and which is loaded in the closing direction by the reduced delivery pressure and in the opening direction by an adjustable required-value spring. If the reduced delivery pressure, set by means of the required-value spring, becomes too high, the flow-resisting member automatically increases the throttle resistance.

In particular, the flow regulating control element may have a diaphragm which is supported by a backing plate and which seals off the delivery chamber from the space accommodating the required-value spring. This provides the further advantage that the required-value spring is positioned entirely outside the supply system and is therefore easily accessible.

Another solution to the problem which can be used simultaneously with the first solution consists in providing a storage chamber, which has a resilient wall, downstream of the magnetic pump. During the pressure stroke this storage chamber receives oil and discharges it during the suction stroke. Consequently a substantially constant pressure, the pulses of which are at most insignificant, obtains in that part of the supply system downstream of the storage chamber.

The storage chamber is preferably disposed upstream of the pressure regulator. Smooth pressure therefore obtains at the pressure regulator and this permits very precise pressure adjustment.

Furthermore, the resilient wall may separate the storage chamber from a suction chamber connected to the suction line. The effect of this is to set up an almost constant suction pressure in the suction line so that knocking is prevented in this line.

In a practical form, the resilient wall may be constituted by a diaphragm which is loaded by an energy-storing spring and is supported by a backing plate.

According to the invention, a third solution to the problem which may also be used in conjunction with the two others, consists in providing a cut-off valve downstream of the pressure regulator, which valve can be actuated by a cut-off control element, the position of which depends upon the delivery pressure, a snap-action spring being interposed between said cut-off valve and said control element.

This cut-off valve has a response hysteresis. This means that the cut-off valve opens at a greater pressure than that at which it closes. This hysteresis can be readily so selected that it is greater than the pressure-differences to be expected as a result of the pressure pulses. In comparison with a cut-off valve having a fixed response value, there is therefore no danger of the cut-off valve continuously opening and closing, since because of the pressure pulses this response value is continuously exceeded or not reached. Also, a very simple construction results because of the presence of the snap-action spring.

Considerable simplification in construction is achieved if the cut-off control element is connected to the resilient wall of the storage chamber. This wall oscillates about a median position which is dependent upon the mean pressure. Despite these oscillations the wall can be used for controlling the cut-off valve since the latter is insensitive to the oscillations because of the presence of the snap-action spring.

For reasons of design it is preferred to provide the cut-off valve with a closing member loaded by a closing spring, and for the cut-off control element, the snap-action spring and an actuating lever, acting on the closing member, to form a three-part snap-action system.

The invention will now be described in greater detail by reference to an embodiment illustrated diagrammatically in the accompanying drawing which shows a cross-section through a means in accordance with the invention.

A magnetic pump 1 has an operating winding 2 which is supplied with, for example, a 220V, 50 cycle current from a normal A.C. supply 5 by way of a switch 3 and a half-wave rectifier 4. A cylindrical armature 6 is connected by a pin 7 to a pump piston 8. Pressure is applied to the pin 7 by an upper compression spring 9 and a lower compression spring 10 which are both supported on surfaces forming part of a housing. When the current is switched on, a pulse occurring fifty times per second is generated and this pulls the armature 6 downwards. This leads to periodic oscillation of the resilient oscillatory system consisting of the parts 6 to 10.

The pump piston moves in a pump cylinder 11 which is connected to the suction line 13 through a suction valve 12, and to the delivery line 15 through a pressure valve 14. A by-pass duct 16 connects the suction line 13 to the interior 17 of the magnetic pump.

A pressure regulator is connected into the delivery line 15. This regulator has a housing 18 with a flow-restricting member 19, the closing member 20 of which is controlled by a pressure-regulating control element 21. This element has a diaphragm 22 with a backing plate 23 and a connecting rod 24 leading to the closing member 20. The delivery pressure, already reduced by the flow-restricting member 19, is applied to the top of the diaphragm 22, and a required-value spring 25 applies load to the bottom of the diaphragm. This spring and the pressure that is required to apply can be adjusted by means of a set-screw 26. The spring and the set-screw are contained in a space separated from the supply system by the diaphragm 22, so that no further sealing means require to be provided.

A line section 27 leads from the pressure regulator to a cut-off valve 28, the closing member 29 of which is loaded by a closing spring 30. The closing member is opened by an actuating lever 31 which, together with a snap-action spring 32 and a cut-off control element 33, forms a three-part snap-action system. These parts are accommodated in a chamber 34 of the housing 35. A further line section 36 runs from this chamber to the nozzle 37.

A line section 38 leads from the delivery line 15 to a storage chamber 39 which is delimited by a resilient wall 40. This wall is constituted by a diaphragm 41 which is supported by a backing plate 42 and a spring 43. Below the wall 40 there is formed a suction chamber 44 which is connected by a line section 45 to the suction line 13. The cut-off control element 33 is also connected to the backing plate 42, and where it extends from the suction chamber 44, the control element 33 is surrounded by a sealing ring 46.

The mode of operation of this fuel oil supply means is as follows. During each cycle of the oscillatory system the pump piston 8 executes a suction stroke and a pressure stroke. During the suction stroke no oil is delivered. During the pressure stroke a certain quantity Q is delivered, and half of this quantity passes to the nozzle 37 through the flow-restricting member 19 and the cut-off valve 28. The other half passes into the storage chamber 39, the wall 40 deflecting under the pressure from the spring 43. The potential energy stored in this way serves to pass oil through the flow-restricting member 20 to the nozzle 37 during the next suction stroke. Therefore, despite intermittent delivery the amount of oil issuing from the nozzle is substantially constant.

Since the pump piston 8 forces oil out of the chamber 17 during the suction stroke, the pump cylinder 11 is mainly refilled with oil from the chamber 17. The suction action of the piston 8 is therefore limited to that of drawing oil into the chamber 17 during the pressure stroke. The use of the suction chamber 44 also results in a suction effect during the suction stroke of the piston 8, i.e. when the storage chamber 39 is reduced in size. Therefore, oil flows in one direction through the suction line 13 both during the pressure stroke and the suction stroke of the piston 8. An almost continuous mean flow is established in which knocking is hardly noticeable.

The pressure-regulating valve operates in the following way: when the delivery pressure rises, the diaphragm 22 is pressed downwards against the force of the spring 25, and the flow-restricting cross-section is reduced. Consequently the throttle resistance becomes greater. The pressure in the line section 27 is therefore approximately constant. A predetermined quantity of oil issues from the nozzle 37 at this pressure. If the pump piston 8 executes longer strokes than correspond to this quantity, the pressure in the delivery line 15 rises. This rise in pressure has a damping effect upon the oscillatory system so that the strokes are automatically limited to the required magnitude.

The cut-off valve 28 is closed until such delivery pressure obtains in the storage chamber 39 that the control element 33 is downwardly displaced to such an extent that the three-part snap-action system, consisting of the actuating lever 31, the snap-action spring 32 and the control element 33, snaps into the other end position so that the closing member 29 is raised. No harm is done if in this position the backing plate 42 periodically moves backwards and forwards over a predetermined distance, since the snap-action system only snaps back when the pressure falls below a predetermined bottom limit. For example, the cut-off valve moves into the open position at 7 atmos. and into the closed position at 4 atmos.

When the magnetic pump is switched on, the flow-restricting member 19 is fully open and the cut-off valve 28 is closed. After a short time the delivery pressure rises. The flow-restricting member 19 closes, and the pressure in the storage chamber 39 gradually rises. As soon as this pressure has reached the upper cut-off limit, the cut-off valve 28 opens, the flow-restricting member 19 commences its pressure-regulating function and normal operation is reached. As soon as the pump is switched off and the delivery pressure therefore drops, the cut-off valve 28 closes when the pressure drops below a bottom cut-off limit.

I claim:

1. A fuel oil supply assembly comprising a magnetic pump having a resilient oscillatory system, said pump having a suction line and a delivery line, a nozzle at the terminal end of said delivery line, a pressure regulator in said delivery line having a flow passage, flow restricting means in said passage including a valve means, spring means biasing said valve means in an opening direction, a storage chamber in said delivery line between said pump and said pressure regulator, said storage chamber having resilient wall means, a suction chamber adjacent said storage chamber, said suction chamber and said storage chamber being separated by said resilient wall means, said suction chamber having fluid communication with said suction line.

2. A fuel oil supply assembly according to claim 1 wherein said resilient wall means is a diaphragm, plate means in said storage chamber in abutting contact with said diaphragm, and spring means biasing said plate means.

3. A fuel oil supply assembly according to claim 2 including a cut-off valve between said pressure regulator and said nozzle, rod means connected to said plate means, a lever and a snap action spring cooperable with said lever between said rod means and said cut-off valve for closing said cut-off valve when there is a predetermined minimum pressure in said storage chamber.

* * * * *